United States Patent [19]

Hesch et al.

[11] Patent Number: 5,052,868

[45] Date of Patent: Oct. 1, 1991

[54] ALL PURPOSE CAR

[75] Inventors: Harold E. Hesch, St. John; Phillip G. Przybylinski, Schererville, both of Ind.

[73] Assignee: Trinity Industries Inc., Dallas, Tex.

[21] Appl. No.: 498,227

[22] Filed: Mar. 23, 1990

[51] Int. Cl.[5] ..... B61D 45/00

[52] U.S. Cl. ..... 410/54; 105/3; 105/419

[58] Field of Search ..... 105/3, 4.1, 4.2, 4.3, 105/355, 404, 411, 413, 416, 419, 421; 410/44, 45, 53, 54, 56, 68, 6, 58, 71, 72

[56] References Cited

U.S. PATENT DOCUMENTS

| | | | |
|---|---|---|---|
| 3,357,371 | 12/1987 | Gutridge | 410/54 |
| 4,233,909 | 11/1980 | Adams et al. | 105/4.1 |
| 4,636,119 | 1/1987 | Terlecky | 410/54 |
| 4,681,040 | 7/1987 | Brodeur et al. | 105/3 |
| 4,686,907 | 8/1987 | Woollam et al. | 410/56 |
| 4,947,760 | 8/1990 | Dawson et al. | 105/3 |

*Primary Examiner*—Matthew C. Graham
*Assistant Examiner*—Mark T. Le
*Attorney, Agent, or Firm*—Baker & Botts

[57] ABSTRACT

A railway car comprising a longitudinal center sill and floor members carried at opposite sides of the sill, and first locking devices mounted on a cross-bearer connected to the center sill and a second set of locking devices mounted on a second cross-bearer and a third set of locking devices movable through the deck and foldable thereunder, the second set of devices pivotal longitudinally of the car between retracted and operative positions, and the third set of the locking devices pivotal transversally of the car.

12 Claims, 2 Drawing Sheets

ALL PURPOSE CAR

BACKGROUND OF THE INVENTION

This invention relates to railroad cars and more specifically to cars which are made to support truck trailers or containers.

In the usual arrangement a train of preferably five cars is provided in which the remote ends of the end cars have standard truck and have standard couplers for coupling with couplers of other cars in a train make up. The interior ends of the end cars and the other three cars have articulated connections for close coupling to accommodate one truck which spans and supports the ends of two adjacent cars.

SUMMARY OF THE INVENTION

The present invention provides cars which have minimal structure for light weight and wherein the cars are constructed to carry either containers or truck trailers.

A different object is to provide a car assembly in which the trailer fifth wheel or coupling is mounted on the center sill and wherein it is adapted to be pocketed so as not to obstruct the positioning thereover of a container.

A further object is to devise a container support or locking arrangement which may be easily converted to carry a truck trailer.

Another object is to provide a car in which locking assemblies extend through trailer support runways when in the container support position and in folded position are disposed below the surface of the runway or floor.

Another object is to provide retractable center container support assemblies extended above the plane of the center sill when in the container support position and when in folded position clearing either 40 or longer containers or a trailer.

These and other objects and advantages inherent in and encompassed by the invention will become more apparent from the specification and the drawings wherein:

DESCRIPTION OF THE INVENTION

Figure 2:
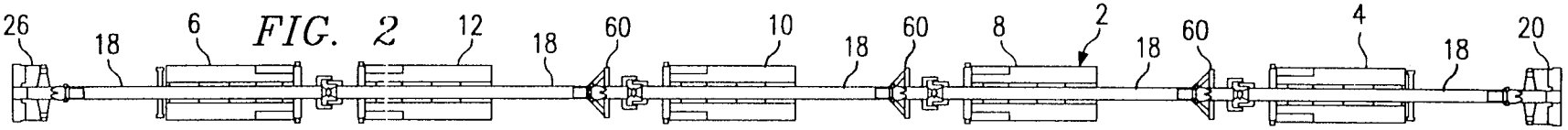
FIG. 2 is a plan view thereof.
Figure 1:
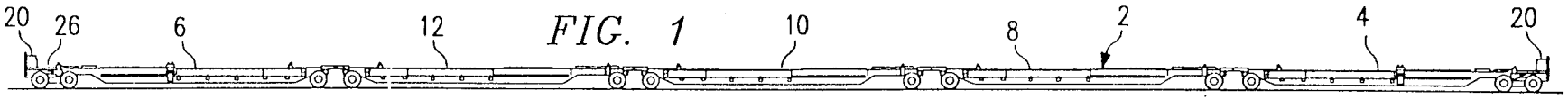
FIG. 1 is a side elevational view of the novel five rail car arrangement.

Describing the invention in detail, the train generally designated 2 is shown in FIGS. 1 and 2 and comprises end cars 4 and 6 and intermediate cars 8, 10 and 12 which are articulatively interconnected to each other. Car 8 is articulatively connected to car 4 and car 12 is similarly connected to car 6. Each car includes a longitudinal center sill 18 which supports the load on the car and withstands towing loads as the train is moved.

The end cars 4 and 6 have end frame assemblies 20, of rectangular shape. Each assembly 20 includes a transverse end sill 21 having transverse walkway portions 22, 22 (See FIG. 4) extending from opposite sides of the center sill 18 and connected thereto.

Figure 5:
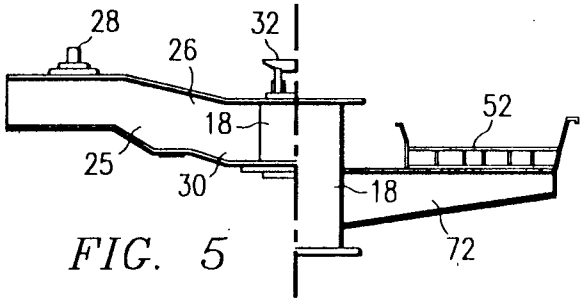
FIG. 5 is a cross-section taken on line 5—5 of FIG. 4.

The ends 24, 24 of the end sill 21 are connected to one of the ends of a longitudinal beam 27 which at its other end is connected to an adjacent end of a cross-bearer 25. The cross-bearer 25 has an upwardly offset portion 26 at each side of the center sill 18 as best shown in FIG. 5. Each offset portion 26 has a fixed upwardly extending container lock 28 at its outer ends. Jacking pads 44 are located at the outer ends of the cross-bearers 25.

The inner ends 30 of cross-bearers 25 are connected to the sides of the center sill 18 and the offset defines a pocket or depression 31 for accommodating the retraction of fifth wheel plate assembly or trailer coupler 32 which is lowered thereinto when the car is used to carry a container which at one end straddles the cross-bearer 25. When the car is carrying a trailer (not shown), the coupler 32 is raised to an operative position as shown in FIG. 5.

Figure 8:
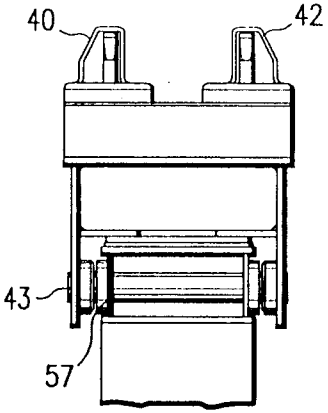
FIG. 8 is an enlarged end view taken substantially on line 8—8 of FIG. 4.

A center cross-bearer 35 is provided at about the center of the car and has inner end portions 36, 36 secured to opposite sides of the center sill 18. Each end portion 36, 36 carries at its ends a pair of container locks 40, 42. The locks 40, 42 are adapted to fold about axis or pin 43 (See FIGS. 8 and 9) extending horizontally lengthwise of the car. The locks 40, 42 are folded when the car carries a 45' or 48' container or when a trailer is loaded and carried.

The car has a further end bolster 41 which extends from opposite sides of the center sill 18 and is provided with jacking pads 44 at its ends. There is a relative vertical offset over the length of the car caused by the positions of the ends of the cross-bearers 25 and 35 relative to the upper surface of the center sill 18. This relationship creates the previously mentioned pocket 31 which further permits more advantageous location of components such as the trailer coupler 32.

Figure 9:
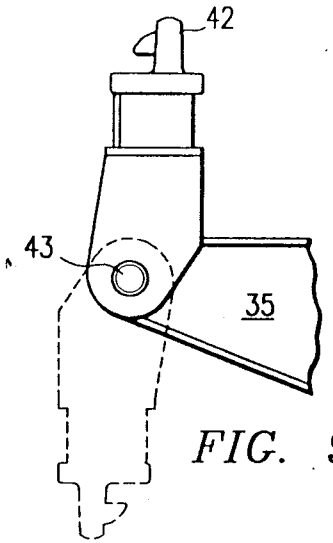
FIG. 9 is a side view of the structure of FIG. 8.

The locks 40, 42 are folded downwardly as shown in dash lines in FIG. 9 when a 48' container is positioned with its ends over the end bolster 41 and cross bearer 25 and secured to the locks 50 and 28, respectively.

Figure 4:
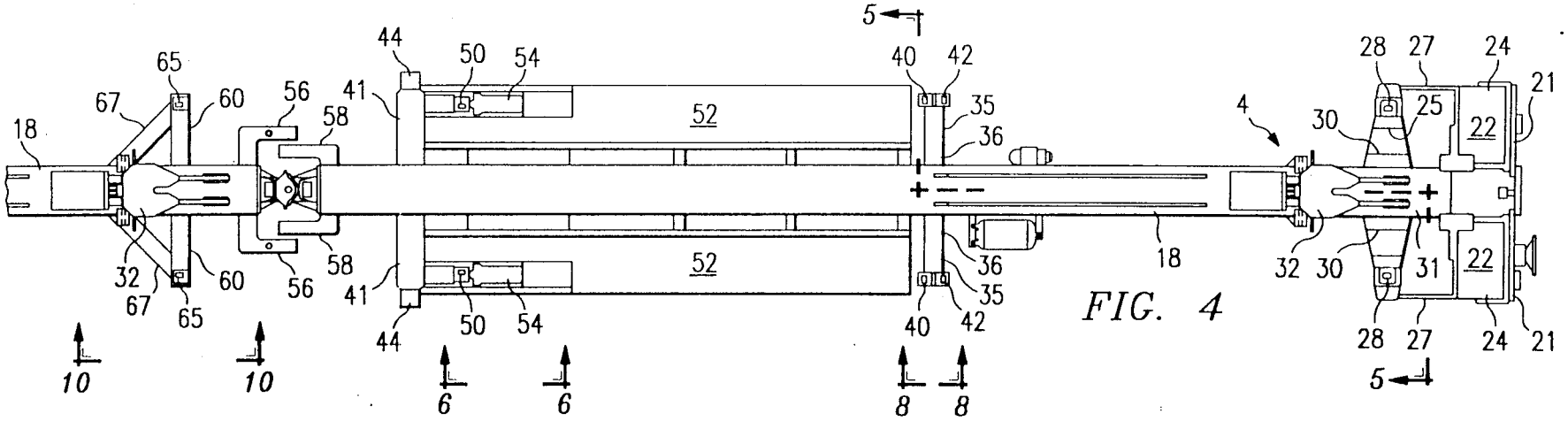
FIG. 4 is a plan view of FIG. 3.
Figure 3:
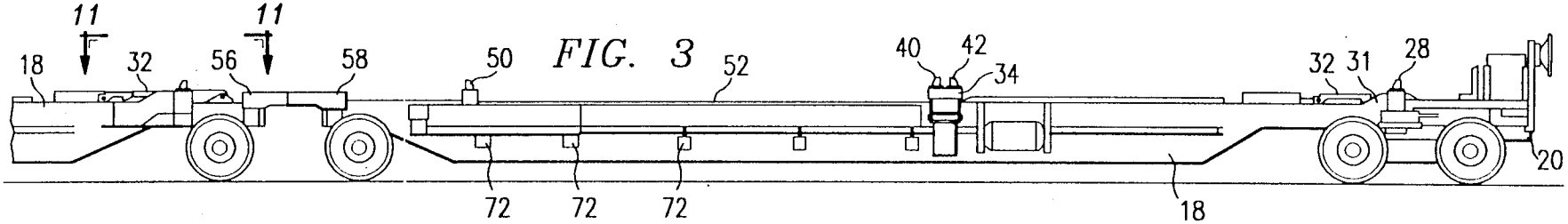
FIG. 3 is an enlarged side elevational view of an end car and a fragmentary view of an end portion of an adjacent intermediate car.
Figure 7:
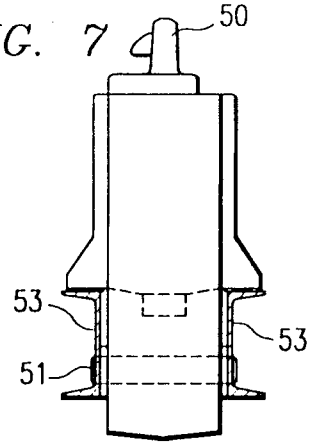
FIG. 7 is a side view of the structure shown in FIG. 6.
Figure 6:
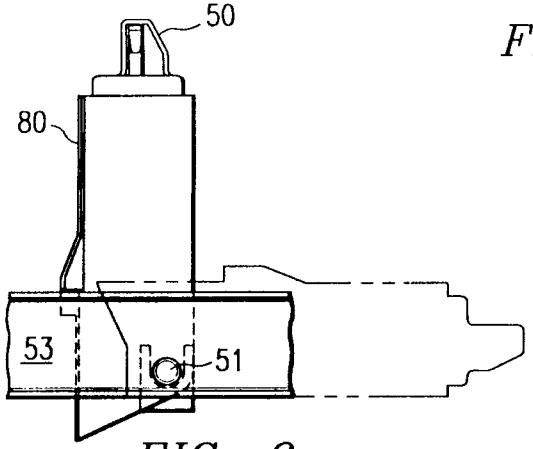
FIG. 6 is an enlarged side elevational view of one of the longitudinally foldable locks taken essentially on lines 6—6 of FIG. 4.

The locks 50, 50 which are in detail in FIGS. 6 and 7 are located in the runways 52, 52. The locks 50, 50 are pivotally supported by and are folded about transverse axes 51 carried by suitable longitudinal beams 53, 53. The locks 50, 50 are pivoted into a stowed position in the runways 52, 52 when a trailer is loaded and carried on the runways 52. Containers will be located on the locks 50, 50 when they are raised to operative positions as shown in solid lines in FIGS. 6 and 7. The locks 50, 50 in the stowed position are located between the longitudinal beams 53, 53. The pivoted covers 54, 54 which are mounted on the runway structure are used to cover the hole created by the raised pivotal locks 50, 50 and retain the locks upright as shown in FIG. 4. A 45' or 48' container is mounted on extended container locks 50, 50 and locks 28, 28 which are advantageously positioned to permit a portion of the container to project beyond the cross-bearer 25. The length of the car, the articulation of joined cars and arrangement of locks provides sufficient clearance for 48' containers when the cars are in transit.

The ends of the center sills 18 of cars 6, 8, 10 and 12 have bearing arms 56, 56 and the opposing end structures of the adjacent cars have arms 58, 58 which arms carry side bearings cooperating with bearing on the truck bolster therebeneath.

Figure 11:
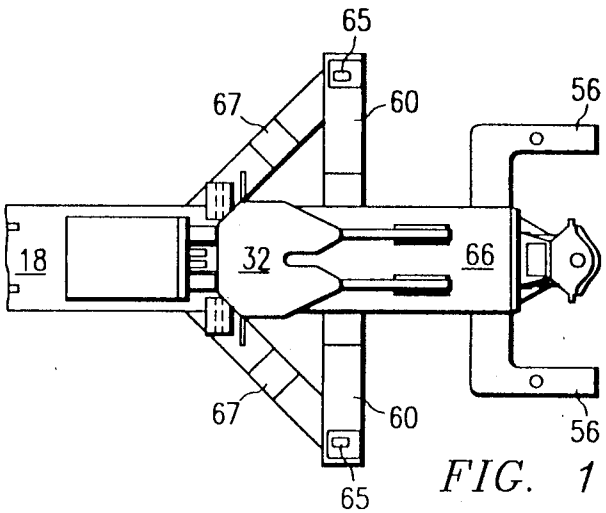
FIG. 11 is an enlarged plan view of a portion of FIG. 4 taken at 11—11.
Figure 10:
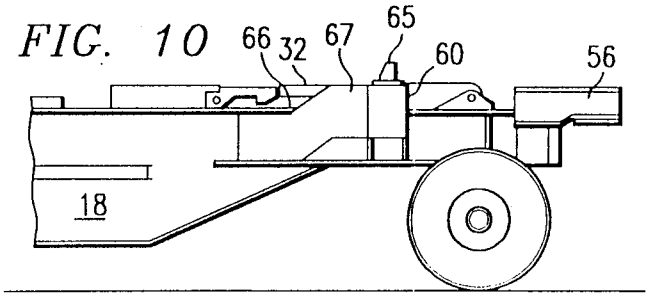
FIG. 10 is an enlarged side elevation taken on line 10—10 of FIG. 4.

Inwardly of one end of each intermediate car 8, 10, and 12 there is provided a cross-bearer 60 (See FIGS. 10 and 11) extending transversely and connected to the center sills 18 thereof. The cross-bearer 60 carries container locks 65 on the free ends thereof that are located relatively above the top surface of the center sill 18. The locks 65 and cross-bearer 60 of each intermediate car are spaced and function the same as locks 28 and 50 on the end cars. The vertical offset provides a pocket 66 for receiving the retracted trailer fifth wheel or coupling 32 located on the intermediate cars.

Each cross-bearer 60 is braced by beams 67, 67 extending diagonally from the ends of member 60 to the center sill 18 and connected therewith.

The intermediate cars 8, 10, and 12 are each provided with runways or decks 52, 52 at each side of the bolster at an elevation below the mounting areas and locks of the cross-bearers as are the runways 52 on the end cars previously described. The tires of the trailers sit upon the runways and the king-pin of the trailer is locked into the adjacent fifth wheel assembly 32.

The runways 52 are carried by cross-beams 72 which taper laterally outwardly and are connected to respective sides of the longitudinal center sill 18. The truck trailers are lifted by hoists and placed on the runways.

It will be seen that container locks 40, 42 are pivoted on a pin 43 and hang over the end of the cross-bearer 35, the pin 43 being mounted in a hinge bracket 56 on the end of the cross-bearer 35.

The locks 50, 50 are pinned on a bolt or pin 51 which extends through longitudinal beams 53, 53 which are positioned at each side of the bolster and connected to the cross-bearers 41 and to part of the tapered cross-beams 72.

The runways or decks 52 are positioned at opposite sides of the center sill 18 and are mounted on the beams 72 and the cross-bearer 41.

The locks 50 project through openings in the runaways 52 when carrying an appropriate container and are folded into the openings in the runways 52. The locks 50 form part of the runways when folded down as shown in FIG. 4.

Reference is made to U.S. Pat. No. 4,750,431 which is incorporated by reference herein.

What is claimed is:

1. An all purpose railway car comprising a longitudinal center sill and having a pair of runways carried at opposite sides of the center sill, and a cross-bearer at one of the ends of said runways extending transversely of the center sill and having container locks at its ends pivotal on axes extending lengthwise of the car for upright position and folded position and in the latter position being hung from the ends of said cross-bearer.

2. The invention according to claim 1, and container locking means extending through said runways.

3. The invention according to claim 2, and said container locking means pivoted about an axis extending transversely of the car and foldable to a position below the runways and presenting a floor surface for engagement by a trailer tire.

4. In a railway car comprising a longitudinal frame including a pair of longitudinal frame members a center sill therebetween, and a foldable fifth wheel assembly mounted on the frame, adapted to be raised into operating position for connection to a trailer and to be lowered into a stowed position above said center sill, container cross-bearers extending from opposite sides of the center sill transversely of the car and having container securing means at their ends, and said ends of said cross-bearers being located at a substantial elevation above the center sill and said cross-bearers having inner end portions sloping downwardly toward the center sill and defining a depression therebetween for receiving said wheel assembly therein when folded beneath a container mounted upon the cross-bearer.

5. The invention according to claim 4, and said securing means pivotally mounted on axes extending longitudinally of the car and, when in inoperative position hanging over the ends of the associated cross-bearer.

6. A railway car for carrying containers and trailers, said car comprising:

a longitudinally extending center sill;

moveable trailer coupling means located on said center sill;

a cross-bearer extending transversely with respect to said center sill and having inner ends connected to said center sill and outer ends elevated above said enter sill forming a pocket with said sill;

container lock means located on the outer ends of said cross-bearer; and a pair of runways for receiving trailer wheels extending generally parallel to said center sill, located on each side of said center sill, and carried thereby.

7. The car of claim 6 and also including moveable container lock means spaced from said first mentioned container lock means and carried by beams operably connected to said center sill, said moveable lock means extending above said runways when in a container engaging position.

8. The car of claim 6 and also including:

a second cross-bearer located between said first mentioned cross-bearer and said moveable container lock means, said second cross-bearer extending transversely to said center sill and having inner ends connected to said center sill; and second moveable container lock means mounted on outer ends of said second cross-bearer.

9. The car of claim 8 wherein each said second moveable container lock means includes a pair of spaced container lock members arranged to engage adjacent ends of a pair of containers carried by said car.

10. The car of claim 6 wherein said moveable trailer coupling means includes:

a coupling member for receiving a trailer hitch pin; and coupling support means connected to said coupling member and to said center sill for mounting said coupling member on said center sill for movement between a stowed position wherein said coupling member is disposed in said pocket and an operative position wherein said coupling member is disposed above said pocket for receiving the trailer hitch pin.

11. The car of claim 8 wherein said moveable trailer coupling means includes:

a coupling member for receiving a trailer hitch pin; and coupling support means connected to said coupling member and to said center sill for mounting said coupling member on said center sill for movement between a stowed position wherein said coupling member is disposed in said pocket and an operative position wherein said coupling member is disposed above said pocket for receiving the trailer hitch pin.

12. The car of claim 9 wherein said moveable trailer coupling means includes:

a coupling member for receiving a trailer hitch pin; and coupling support means connected to said coupling member and to said center sill for mounting said coupling member on said center sill for movement between a stowed position wherein said coupling member is disposed in said pocket and an operative position wherein said coupling member is disposed above said pocket for receiving the trailer hitch pin.

* * * * *

UNITED STATES PATENT AND TRADEMARK OFFICE

CERTIFICATE OF CORRECTION

PATENT NO. : 5,052,868

DATED : October 1, 1991

INVENTOR(S) : Harold E. Hesch, et al.

It is certified that error appears in the above-identified patent and that said Letters Patent is hereby corrected as shown below:

Column 1, line 37, change "40" to --40'--.

Signed and Sealed this

Eighth Day of February, 1994

Bruce Lehman

*Attest:*

BRUCE LEHMAN

*Attesting Officer*

*Commissioner of Patents and Trademarks*